US006044974A

United States Patent [19]

Webb et al.

[11] Patent Number: 6,044,974

[45] Date of Patent: Apr. 4, 2000

[54] PACKAGE FOR MATING MACHINE COMPONENTS

[75] Inventors: H. Richard Webb, Chesterfield; Peter W. Webb, New Haven; Richard A. Libby, Foristell, all of Mo.

[73] Assignee: Innovative Enterprises, Inc., Washington, Mo.

[21] Appl. No.: 09/205,918

[22] Filed: Dec. 4, 1998

[51] Int. Cl.[7] ..... B65D 19/00

[52] U.S. Cl. ..... 206/386; 206/589; 206/592; 206/594

[58] Field of Search ..... 206/521, 585, 206/587, 589–594, 386, 499, 701

[56] References Cited

U.S. PATENT DOCUMENTS

| | | | |
|---|---|---|---|
| 3,008,572 | 11/1961 | Wagner | 206/386 |
| 4,027,794 | 6/1977 | Olson | 206/386 |
| 4,474,293 | 10/1984 | Osborne | 206/497 |
| 4,998,619 | 3/1991 | Sowa et al. | 206/392 |
| 5,000,372 | 3/1991 | Hollander et al. | 206/386 |
| 5,462,171 | 10/1995 | Moog et al. | 206/592 |

*Primary Examiner*—Paul T. Sewell
*Assistant Examiner*—Nhan T. Lam
*Attorney, Agent, or Firm*—Polster, Lieder, Woodruff & Lucchesi, L.C.

[57] ABSTRACT

Matched and mated machine components, such as those on which the scrolls of scroll-type compressors are located, are fitted together, yet physically isolated from each other, by separators that are formed from corrugated paperboard. Each separator has a planar peripheral portion, which lies between and faces end surfaces on the mating components, and fingers which fit between the interfitting segments. The sets of mating machine components are placed on pads formed from paper honeycomb material, and these pads have pockets which receive one component of each set and prevent the components from shifting laterally. The pockets are derived by die cutting the honeycomb material through one of its facer sheets and then crushing the cells that lie within the cut. The pads with the sets of mating, yet isolated, components on them are stacked one upon the other. A tray lies beneath the stack and a cover fits over it and telescopes with respect to the tray to completely enclose the stack.

13 Claims, 6 Drawing Sheets

PACKAGE FOR MATING MACHINE COMPONENTS

CROSS-REFERENCE TO RELATED APPLICATIONS

STATEMENT REGARDING FEDERALLY SPONSORED RESEARCH OR DEVELOPMENT

Not Applicable.

BACKGROUND OF THE INVENTION

This invention relates in general to packaging and, more particularly, to a package for shipping products, preferably in bulk quantities, and to a separator for separating matched and mated components of products, as well as to a method of shipping such machine components.

Some compressors utilize mating scrolls to compress fluids such as refrigerants. In the typical scroll-type compressor one of the scrolls is on a fixed component, while the other is on a movable component. When the movable component orbits with respect to the fixed component, the fluid, which is trapped between them, is compressed.

The fixed and orbital components having the scrolls are machined to close tolerances, so that a specific fixed component mates with a specific orbital component. This requires special skills and equipment often not available where the compressors are assembled. Hence, the components are typically shipped to the place of assembly, with the matched fixed and orbital components in large bulk containers, but nevertheless separated in those containers. This consumes considerable space in packing containers. Moreover, by reason of the close tolerances, some arrangement must exist to insure that the matched fixed and orbital components are united in pairs that properly mate once they are removed from the package. Furthermore, the precision with which the components are manufactured is lost if the components suffer damage during shipment. Therefore, measures must be taken to prevent damage to the components—and particularly their scrolls—during transit.

BRIEF SUMMARY OF THE INVENTION

The present invention resides in a package for holding multiple products such that they will not shift with respect to each other. The package includes resilient pads arranged in layers, with each pad having pockets for receiving projections on the products. The pads are stacked one over the other with the products interposed between them. The stack of pads and products, in turn, may be enclosed in a tray and cover. Each product may comprise matched components which mate in the sense that a portion on one component fits into the other component. A separator fits around the projecting segment on the one component and into the other component as well as between end surfaces of the two components, so that the matched components, while remaining together and mated, are nevertheless physically isolated from each other. The invention further resides in the process for packaging products having matched and mated components by using the pad and separators. The invention also consists in the parts and in the arrangements and combinations of parts hereinafter described and claimed.

BRIEF DESCRIPTION OF THE SEVERAL VIEWS OF THE DRAWINGS

In the accompanying drawings which form part of the specification and wherein like numerals and letters refer to like parts wherever they occur

DETAILED DESCRIPTION

Figure 1:
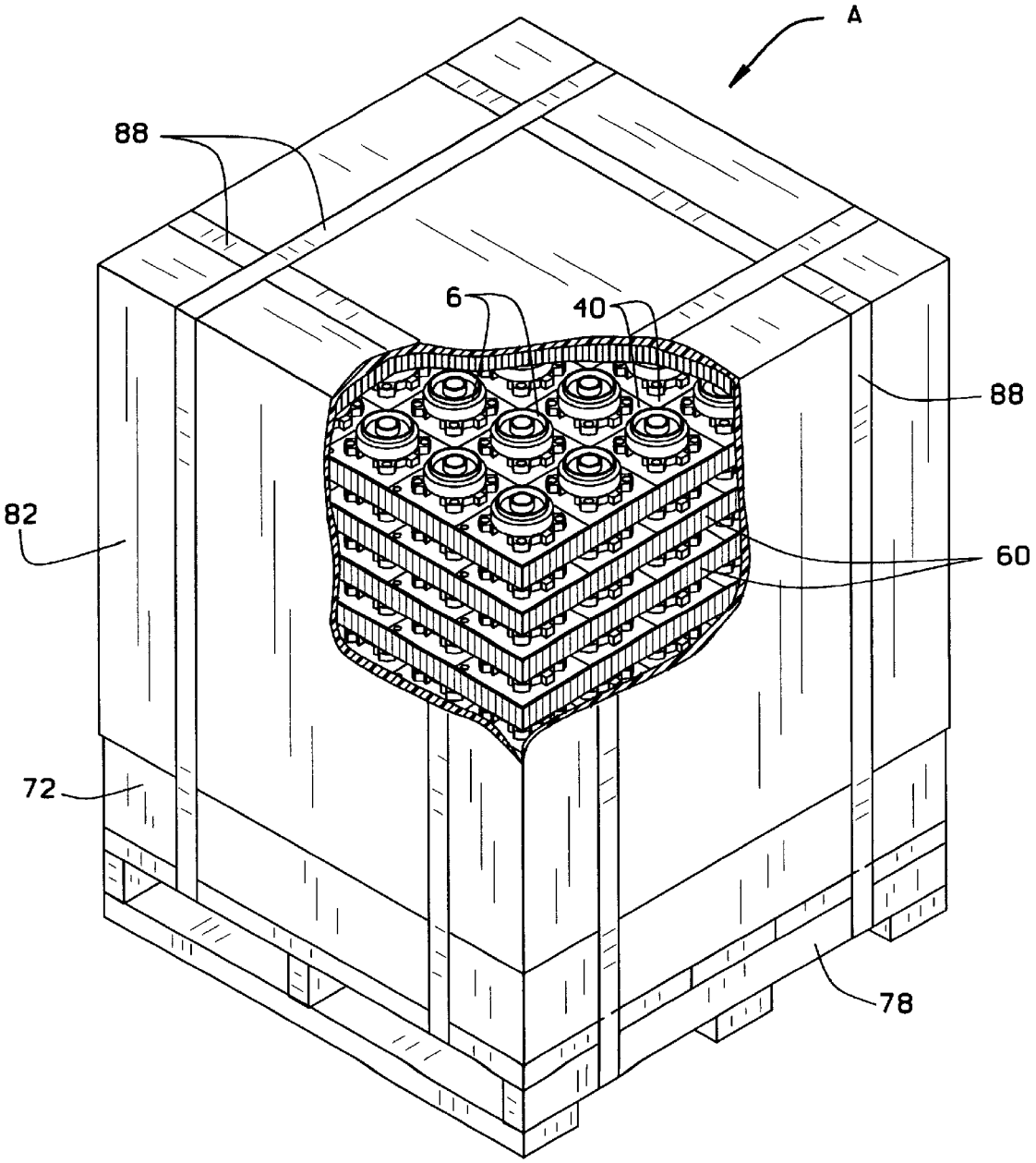
FIG. 1 is a perspective view of a package constructed in accordance with and embodying the present invention, with the package being partially broken away to illustrate the sets of machine components that are contained within it.

Referring now to the drawings, a package A (FIGS. 1 and 2) holds mating machine components 2 and 4 which are supplied in matched sets 6 (FIG. 3), that is to say, for every component 2 there is a mating component 4 which matches it to close tolerances. Each set 6 in effect constitutes a manufactured product. The components 2 and 4 remain together in the sets 6, so they need not be identified and matched at a later time, yet within each set 6 the mating components 2 and 4 are isolated from each other, so that one will not damage the other. Moreover, the sets 6 are likewise isolated from each other within the package A which contains multiple sets 6 packaged in bulk form. Thus, when the package A arrives at its destination, the components 2 and 4 may be removed from it in matched sets 6 without the bother of matching each component 2 with its corresponding component 4.

Typically, the components 2 and 4 form part of a scroll-type compressor—indeed, the parts which actually effect the pumping of a fluid in the compressor. To this end, the component 2 is generally fixed in relation to the compressor housing, whereas the component 4 within the housing orbits relative to the component 2, it being driven by a motor which is likewise in the housing.

Figure 3:
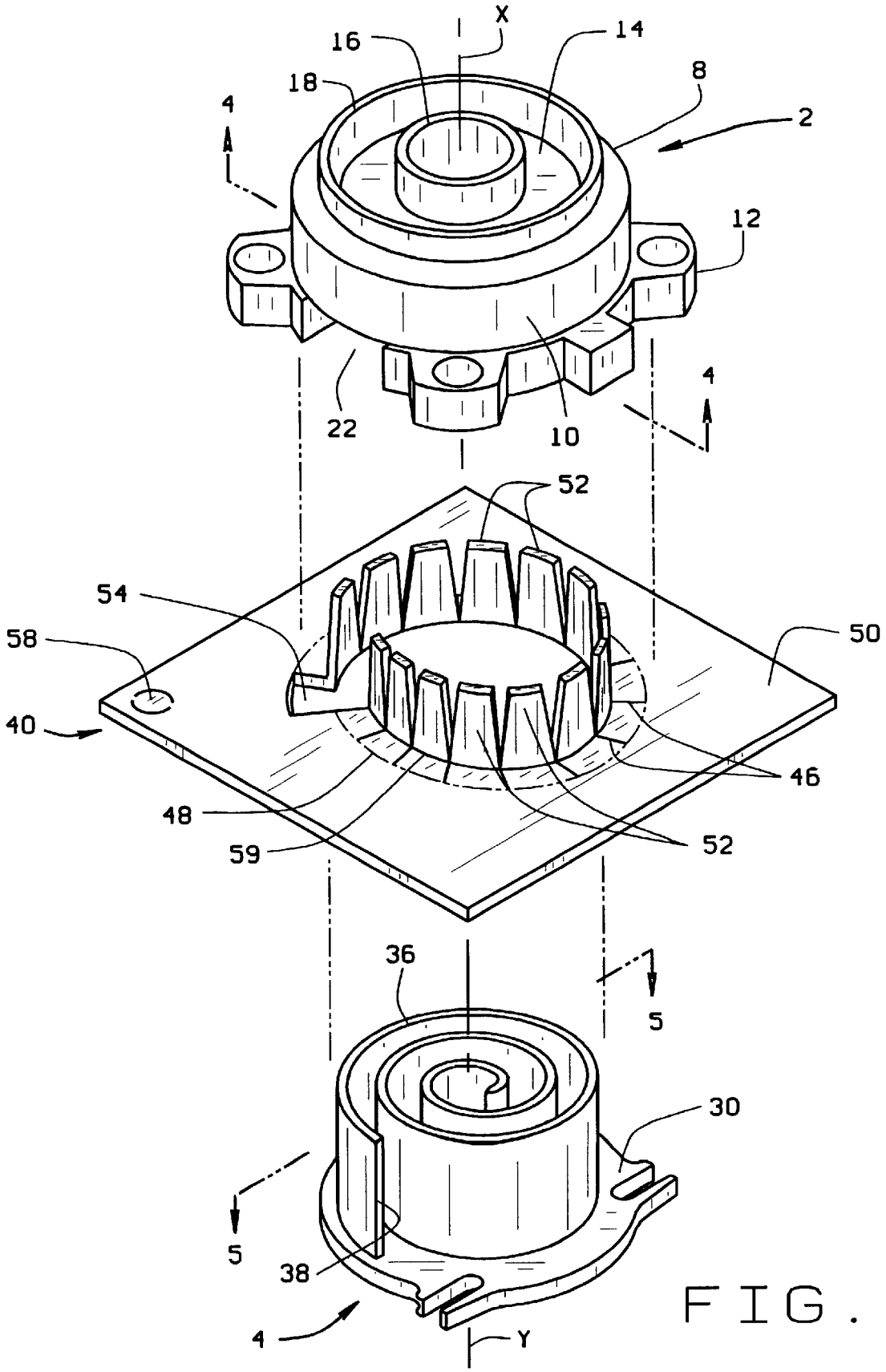
FIG. 3 is an exploded perspective view of a set of matched fixed and orbital components and the separator which fits between them to physically isolate them when they are mated.
Figure 4:
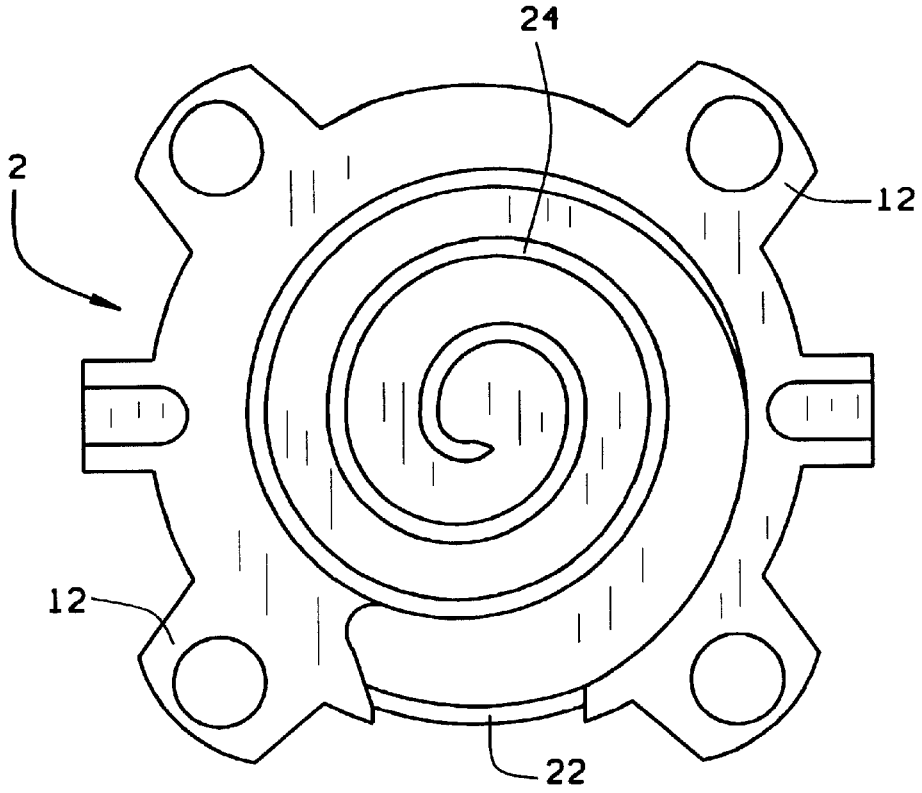
FIG. 4 is an end view of the fixed component showing the scroll and flange on it.

More specifically, the fixed component 4 (FIGS. 3 and 4) has a shell 8 including generally cylindrical wall 10 and a flange 12 which projects from the wall 10. Here the shell 8 is generally open (FIG. 4). The other end of the shell 8 is closed and provided with a groove 14 which lies between inner and outer annular rings 16 and 18, the former projecting slightly beyond the latter. The flange 12, on the other hand, provides a generally flat end surface 20 which surrounds the hollow interior of the shell 8. Indeed, the hollow interior opens axially out of the shell 8 at the flat end surface 20. But, the flange 12 is interrupted at a gap 22 where the hollow interior opens laterally out of the shell 8 as well. The fixed component 2 within the hollow interior of its shell 8 contains a scroll 24 which spirals inwardly from the wall 10 to an axis X that is perpendicular to the plane of the end surface 20.

Figure 5:
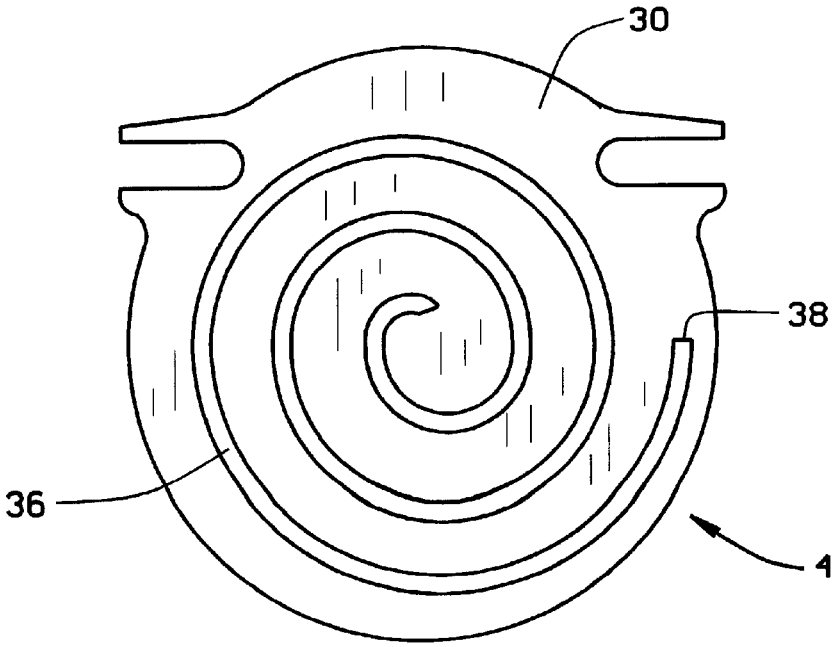
FIG. 5 is an end view of the orbital component showing the scroll on it.
Figure 7:
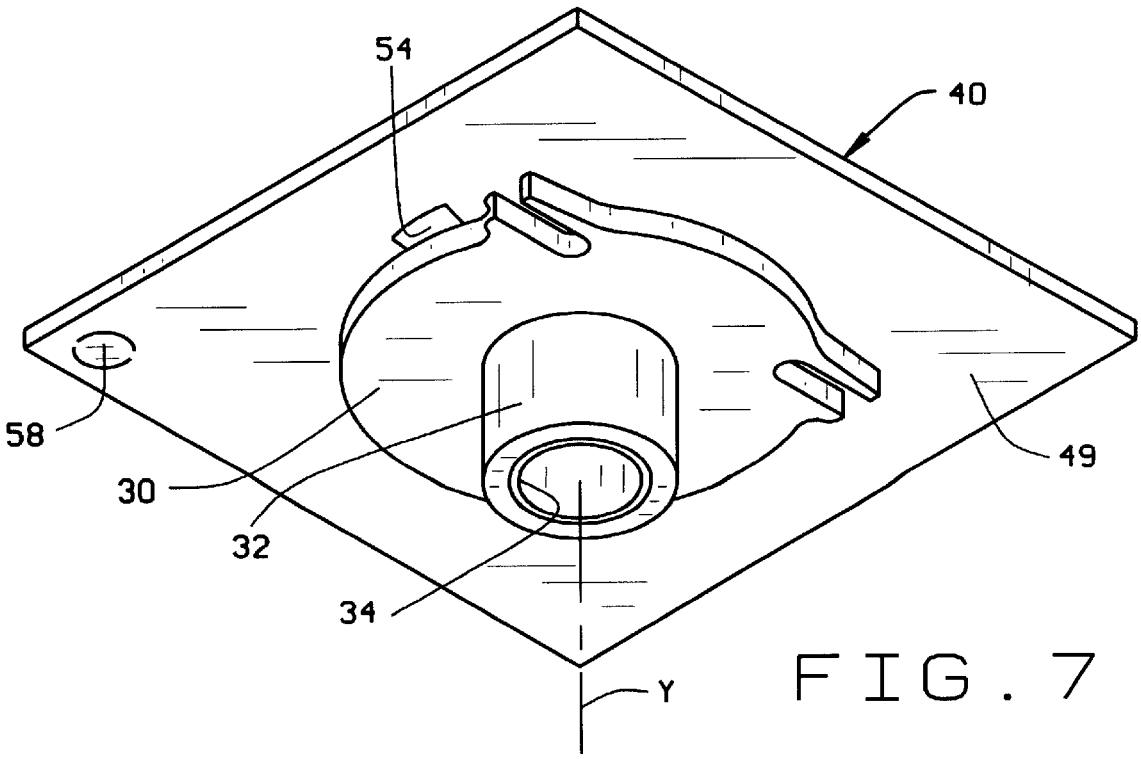
FIG. 7 is a bottom perspective view of the mated components fitted to the separator.

The orbital component 4 (FIGS. 3, 5 and 7) has a disk 30 and a spindle 32 which projects from one face of the disk 30 to define another axis Y. That face likewise forms an end surface as does the opposite face of the disk 30. The spindle 32 contains a sleeve bearing 34 for receiving a motor-driven pin that orbits and thus imparts an orbital motion to the component 4. The outer diameter of the spindle 32 is about the same as the outer diameter of the annular inner ring 16 on the fixed component 2. The component 4 also has a scroll 36 which projects axially from the other face of the disk 30, beginning at an axially directed edge 38 which lies slightly inwardly from the periphery of the disk 30 and spiraling inwardly toward the axis Y of the disk 30. The scroll 36 of the orbital component 4 is configured to mate with scroll 24 of the fixed component 2 when the edge 38 on the component 4 lies in the region of the gap 22 in the component 2. When so mated, the disk 30 of the component 4 overlies the flange 12 of the component 2.

Figure 8:
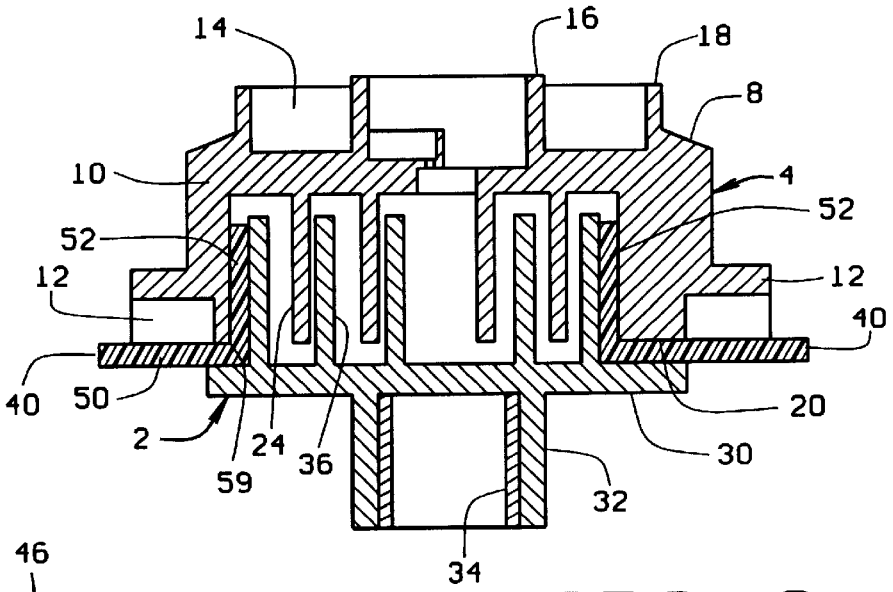
FIG. 8 is a sectional view of the mated fixed and orbital components and the intervening separator taken along line 8—8 of FIG. 6.

To begin with, the package A includes a separator 40 (FIG. 3) for each set 6 of matched components 2 and 4. The separator 40 for any set 6 allows the components 2 and 4 of the set 6 to remain mated—that is with the scroll 36 of the component 4 received in the scroll 24 of the component 2—while still having the components 2 and 4 physically isolated from each other in the sense that they do not contact each other. The separator 40 lies between the disk 30 of the component 4 and the flange 12 of the component 2 and hence keeps the components 2 and 4 apart in those regions. It also prevents the scrolls 24 and 36 of the two components 2 and 4 from coming together (FIG. 8). In addition to physically isolating the components 2 and 4 between which they fit, the separators 40 serve to isolate the matching sets 6 of components 2 and 4 from one another.

Figure 9:
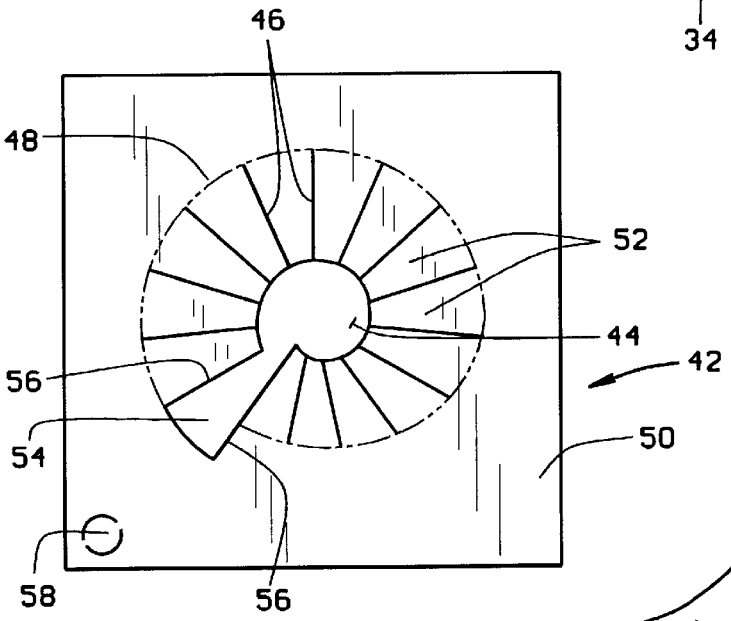
FIG. 9 is a plan view of the blank from which the separator is derived.

Each separator 40 derives from a square blank 42 (FIG. 9) preferably made of double wall corrugated paperboard. As such, the paperboard has three flat layers of paper with two corrugated layers interposed between the flat layers so the flat layers are separated. Other materials, such as single wall corrugated paperboard, solid fiber board, and foam sheet, will also suffice for the separator 40. The blank 42 has a spiral cutout 44 at its center and slits 46 that generally radiate from the cutout 44. The outer ends of the slits 46 define another spiral 48 that generally follows the margin of the spiral cutout 44, but the spiral 48 merely serves as a reference and is not discernible other than by visualizing the ends of the slits 46. The spiral 48 conforms generally to the first or outermost convolution of the scroll 36 on the orbital component 4, although is probably larger. Around the spiral 48, the separator 40 is generally flat, this being a peripheral region 50. The slits 46 divide the region of the blank 42 that lies within the spiral 48 into generally radially directed fingers 52. Between the largest finger 52 and the smallest finger 52, the blank 42 contains another cutout 54 which opens into spiral center cutout 44. The cutout 54 has radial margins 56, one of which lies along the largest finger 52 and the other along the smallest finger 52. Indeed, the latter margin continues past the small end of the spiral 48 to the offset large end of the spiral 48. The cutout 54 projects toward one of the four corners of the blank 42, and at that corner the blank 42 has a small orientation marker 58.

To install the separator 40 on the orbital machine component 4, one places the blank 42 against the end of the scroll 36 with the center of the spiral cutout 44 generally coinciding with the axis Y of the orbital component 4 and the spiral 48 generally lying parallel to the outer convolution on the component 4. Moreover, the longer of the two radial margins 56 for the cutout 54 is aligned with the end edge 38 of the scroll 36. The fingers 52, in effect, support the separator 40 at this juncture on the scroll 36 of the component 4. The blank 42 is then forced toward the disk 30 of the orbital component 4, with the force being applied against the fingers 52 only slightly outwardly from the outer convolution of the scroll 36. The fingers 52 bend at this region and acquire fold lines 59, while the planar peripheral region 50 and the adjoining undistorted portions of the fingers 52 advance toward the disk 30. This transforms the blank 42 into the separator 40 (FIG. 3). Since the fold lines 59 may exist anywhere along the fingers 52, the separator 40 can accommodate orbital components 4 of different sizes. A fixed component 2 with its scroll 24 removed may be used to apply the force since the inner surface of its cylindrical wall 10 conforms to and is only slightly larger than the outer convolution of the scroll 36 on the orbital component 4.

Figure 6:
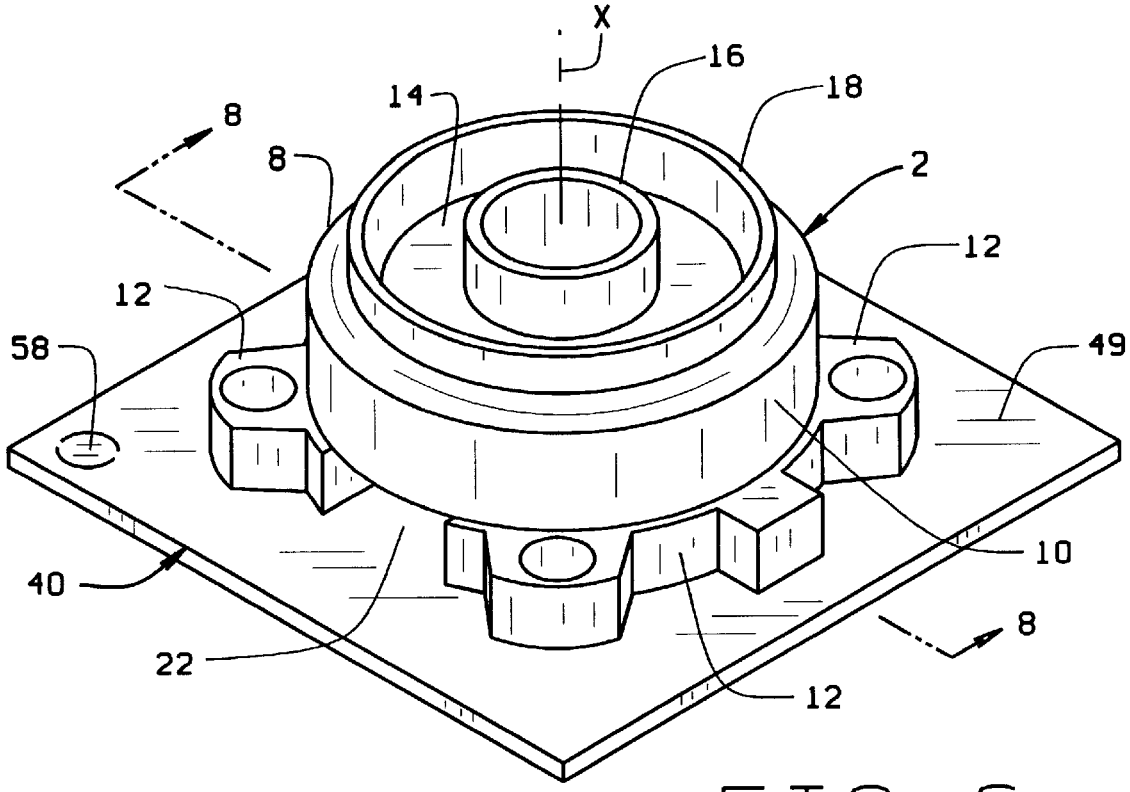
FIG. 6 is a top perspective view of the set of components fitted to the separator.

When the separator 40 is fully installed on the orbital machine component 4 (FIGS. 6 and 7), the fingers 52 of the separator 40 are directed axially at the fold lines 59 and lie along the outside surface of the outer convolution for the scroll 36. But they are not as long as the scroll 36 is deep, and hence terminate short of the spiral end surface for the scroll 36. Moreover, the longer of the two radial margins 56 for the cutout 54 lies along the axial end edge 38 of the scroll 36.

With the separator 40 installed on the orbital component 4, the orbital component 4 is fitted to its matching fixed component 2 to produce a matched set 6. To this end, the two components 2 and 4 are presented opposite each other with their scrolls 24 and 36 generally aligned. Also, the orbital component 4 is rotated until the axial edge 38 on its scroll 36 is located at the region of the gap 22 in the flange 12 of the shell 8 for the fixed component 2. Even though the separator 40 may obscure the scroll 36 of the orbital component 4, the orientation marker 58 designates its angular orientation, and with the gap 22 in the fixed component 2 plainly visible, it is a relatively simple matter to properly orient the orbital component 4 angularly with respect to the fixed component 2. When so oriented, the scroll 36 of the orbital component 4 slides into the scroll 24 of the fixed component 2, notwithstanding the fingers 52 around the former. But the scrolls 24 and 36 of the two components 2 and 4 do not actually contact each other because the fingers 52 of the separator 40 lie between the outer convolution of the scroll 36 on the orbital component 2 and the surface which forms the outer convolution on the scroll 24 of the fixed component 4, that surface actually being the inner surface of the wall 10 in the shell 8.

Figure 2:
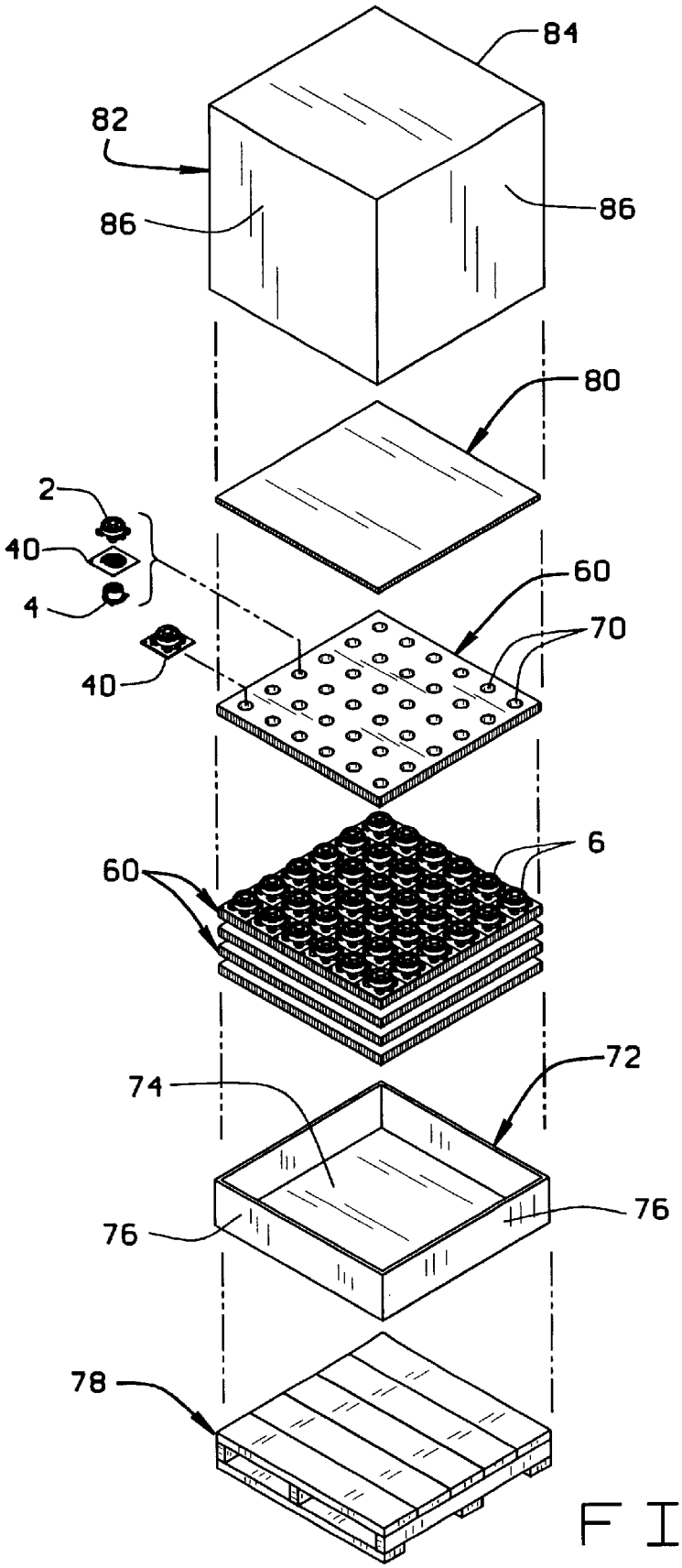
FIG. 2 is an exploded perspective view of the package.

Thereupon, the orbital component 2 is rotated to move its axial edge 38 away from the large end of the scroll 24, and this brings the large convolution of the two scrolls 24 and 36 together. Indeed, the fingers 52 on the separator 40 become lodged between the large convolutions of the two scrolls 24 and 36 (FIG. 8), and this prevents the mated machine components 2 and 4 from shifting relative to one another. Yet, the large convolutions of the two scrolls 24 and 36 remain separated by the thickness of the fingers 52. The remaining convolutions are configured such that they remain separated as well. The separator 40 in its peripheral region 50 also lies between the disk 30 of the orbital component 2 and the flange 12 of the fixed component 4. Thus, no surface of the orbital component 4 contacts a surface of the fixed component 2. The mated components 2 and 4, while being fitted to each other, remain totally isolated from each other Within the package A, the sets 6 of matched and mated fixed and orbital components 2 and 4 are arranged in layers, and within each layer the sets 6 of components 2 and 4 are arranged in rows (FIG. 1). The mated components 2 and 4 of each layer in turn rest on a rectangular pad 60, with the rows of components 2 and 4 being parallel to the side and end edges of the pad 60. The edges of the several pads 60 register, and the pads 60 serve to separate the layers of components 2 and 4 from each other.

Figure 10:
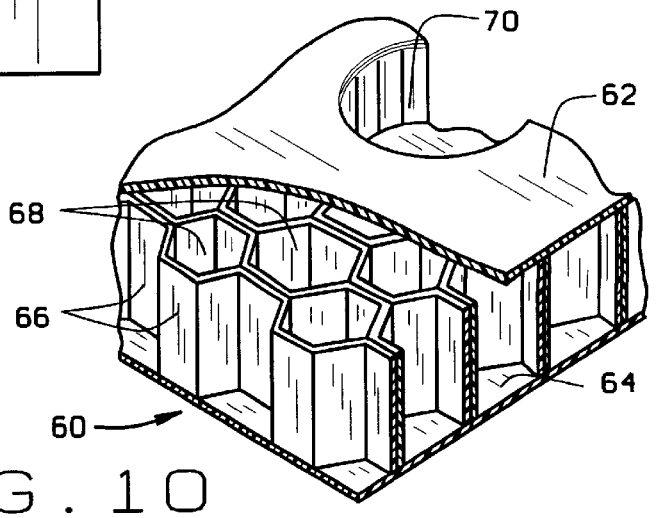
FIG. 10 is a fragmentary sectional view, partially broken away and in section of one of the honeycomb pads for the package.

Each pad 60 is preferably formed from a paperboard honeycomb material and as such includes upper and lower facer sheets 62 and 64 that are formed from paper and lie parallel to each other and paper honeycomb 66 that lies between the facer sheets 62 and 64 (FIG. 10). Indeed, the intervening paper honeycomb 66 along its end margins is attached to the facer sheets 62 and 64 with glue. The honeycomb 66 contains a multitude of hexagonal honeycomb cells 68, the axes of which lie parallel to each other and perpendicular to the facer sheets 62 and 64. However, other types of packaging materials, such as built-up corrugated paperboard and foamed polymers, are suitable for the pads 60.

Each honeycomb pad 60 has pockets 70 of cylindrical shape opening out of its upper facer sheet 62 (FIG. 2), and these pockets 70 are large enough to receive the spindles 32 on the orbital components 4, although with little clearance. The spindles 32 of the orbital components 4 fit into the pockets 70, while the components 2 and 4 are isolated from each other with the separators 40. The pockets 70 are just deep enough to allow the ends of the spindles 32 on the orbital components 4 to compress the crushed honeycomb 66 at the bottoms of the pockets 70 rather firmly, while the disks 30 of the orbital components 4 settle against the upper facer sheet 62 of the pad 60, perhaps under the weight of other sets 6 of mated components 2 and 4 above them. This presents the separators 40 in a common plane slightly above the upper facer sheet 62 for the pad 60. The spacing of the pockets 70 is such that the separators 40 form a mosaic in which little clearance exists between the edges of adjacent separators 40 (FIG. 1). As such, the separators 40 for a pad 60 cannot rotate over the pad 60, and this further fixes the sets 6 of matched and mated components 2 and 4 in position on the pad 60.

To form the pockets 70, each pad 60 is die cut through its upper facer sheets 62 and through the underlying cells 68 to a depth slightly exceeding the length of the spindle 32, with the die cut, of course, being in the shape desired for the pocket 60, that is preferably circular and slightly larger in diameter than the spindle 32. At the same time, the region within each die cut is forced downwardly toward the lower facer sheet 64 to crush the cells 68 that lie below the pocket 70.

Thus, the sets 6 of machine components 2 and 4 that rest on each pad 60 cannot shift laterally on the pad 60 owing to the projection of the spindles 32 into the pockets 70 of the pad 60, nor can they rotate on the pad 60 owing to close-fitting separators 40 of rectangular shape. The pad 60 for each layer above the lowest rests on the annular rings 16 and 18 for the fixed components 4 in the underlying layer. The rings 16 and 18 sink slightly into the lower facer sheet 64 for the pad 60 that lies over them. Moreover, the inner ring 16 on each fixed component 4 in a set 6 aligns with the spindle 32 of the orbital component in the set 6 that is above. The honeycomb 66 that lies crushed at the bottom of the pocket 70 in which that spindle 32 is contained remains firm enough to transfer some of the weight of the overlying set 6 to the underlying set 6, while the rest of the weight is transferred through the honeycomb 66 that remains intact in the surrounding regions underlying the disks 30. Thus, the sets 6 of mated components 2 and 4 that lie one above the other, together with the intervening crushed honeycomb material which separates those sets at the bottoms of the pockets 70, form a load-bearing column in the package A.

The lowest pad 60 lies within a tray 72 (FIG. 2) having a bottom wall 74, on which the pad 60 actually rests and side walls 76 which turn inwardly from the bottom wall 74 and lie along the sides of the lowest pad 60 as well as several above it. The tray 72, in turn, rests on a wood pallet 78.

The mated fixed and orbital components 2 and 4 of the top layer, on the other hand, lie beneath a top pad 80 (FIG. 2) which is considerably more rigid than the underlying support pads 60. The top pad 80 may be formed from a material consisting of upper and lower facer sheets and an intervening layer of corrugated and flat sheets arranged perpendicular to the facer sheets. A material of this construction is sold by Northern American Container Corporation, Mableton, Ga., under the trademark FIBRE/CORE.

The stack of alternating sets 6 of mated machine components 2 and 4 and pads 60 is enclosed in a cover 82 (FIGS. 1 and 2), which also forms part of the package A, it having a top wall 84 and side walls 86 which are connected to the top wall 84. The top wall 84 lies over the top pad 80 in the stack, while the side walls 86 descend along the side edges of the stacked pads 60 and overlie the side walls 76 of the tray 72 at the bottom of the stack. As such, the cover 82 telescopes over the tray 72.

Finally, the package 4 has bands 88 (FIG. 1) which fit, preferably in two directions over the cover 82 an beneath the tray 72. Actually, the bands 88 in the region of the tray 72 fit through the pallet 78, so the pallet 78, the tray 72 and the cover 82 are held together with the pads 60 and 80 and the sets 6 of machine components 2 and 4 enclosed by them. The bands 88, when tightened during their installation compress the package A only slightly, since the columns formed by the stacked sets and the intervening crushed honeycomb cells 68 have the capacity to carry loads. While the crushed honeycomb material 66 at the bottoms of the pockets 70 may accommodate some further compression, it is nevertheless crushed to the extent that the further compression is quite limited or in other words, is in a relatively firm condition.

The package A keeps the mated components 2 and 4 united so that upon removal from the package A they can be readily assembled into a compressor without wasting time attempting to match each component 2 with its mating component 4. Since the components 2 and 4 are mated in the package 4, the package A consumes less space than packages where the components 2 and 4 are separated. Within the package A the matched and mated components 2 and 4 are held firmly in place. They cannot shift laterally, or vertically, nor can they rotate. Moreover, the components 2 and 4 of each set 6 are isolated from each other so they cannot damage each other. The pads 60 and 80 project laterally beyond the sets 6 of mated components 2 and 4 in the outermost rows and absorb side impacts as, of course, do the side walls 76 and 86 of the tray 72 and cover 82. The columns formed by the stacked sets 6 and intervening crushed honeycomb 66 keep the package A from settling, even when transported significant distances, and as a consequence the bands 88 remain reasonably taut. Indeed, the columns enable several packages A to be stacked two and three high without significant compression of the lowermost package A.

This invention is intended to cover all changes and modifications of the example of the invention herein chosen for purposes of the disclosure which do not constitute departures from the spirit and scope of the invention.

What is claimed is:

1. In combination with a plurality of rigid products, a package for shipping the products, said package comprising: a plurality of pads arranged in layers, one above the other, each pad being formed from a honeycomb material having parallel facer sheets and honeycomb cells interposed between the facer sheets, with the axes of the cells being perpendicular to the facer sheets, each pad having pockets that open out of one of its facer sheets toward the adjacent pad with the honeycomb material at the ends of the pockets beings crushed to a relatively firm condition, each pocket receiving a first portion of a rigid product so that the product is prevented from shifting laterally on the pad, the first portion of the product being against the end of the pocket at which the crushed honeycomb material is located, each product having a second portion that is against the adjacent pad toward which the pocket, in which the first portion is located, opens, the products being captured between adjacent pads and being arranged one over the other in columns, with the second portion of any product being aligned with the first portion of a product that is on the adjacent pad against which that second portion bears, whereby the products in a column are separated by the crushed honeycomb material, the products in a column together with the crushed honeycomb material between the products in the column having the capacity to transfer loads through the column without significant compression of the package.

2. The combination according to claim 1 wherein one of the pads forms an uppermost pad and another of the pads forms a lowermost pad, and the remaining pads are between the uppermost and the lowermost pads; wherein the package further comprises a cover which extends over the uppermost pad and has side walls located along the sides of at least some of the pads, and a tray which extends under the lowermost pad and has side walls which extend upwardly along the sides of at least some of the pads; and wherein the side walls of the cover telescope with respect to the side walls of the tray.

3. The combination according to claim 2 wherein the package further comprises a pallet on which the tray rests.

4. The combination according to claim 1 wherein the pockets open upwardly.

5. The combination according to claim 4 wherein each product has a spindle; and wherein the pockets in the pads receive the spindles of the products.

6. In combination with first and second metal components which mate in the sense that a projection on the first component fits into the second component, each component having an end surface and a scroll formed by convolutions, and the two components being fitted together such that the scroll on the first component receives the scroll on the second component and the end surfaces are presented opposite and close to each other, a separator for physically isolating the components while they are fitted together, said separator being formed from a relatively soft sheeting material and having a peripheral portion and fingers projecting from the peripheral portion, the peripheral portion being generally between the end surfaces of the two components and the fingers being between opposite convolutions on the scrolls of the two components, whereby the components are physically isolated from each other.

7. The combination according to claim 6 wherein the first component contains a shell in which its scroll is located, and the second component has a disk on which its end surface is located, with the scroll for the second component projecting from the disk; and wherein the fingers for the separator lie between the largest convolutions on the scrolls of the first and second components.

8. The combination according to claim 7 wherein the peripheral portion is generally planar; and wherein the fingers fold outwardly from the plane of the peripheral portion.

9. The combination according to claim 8 wherein the peripheral portion is rectangular.

10. The combination according to claim 9 wherein the fingers are connected to the peripheral portion in a spiral configuration, wherein the large end of the spiral is set inwardly from a corner of the rectangular peripheral portion; and wherein the peripheral portion has a marker at that corner to mark the large end of the spiral.

11. In combination with a plurality of rigid products, each of which has two components which fit together and mate, a package for shipping the products, said package comprising: a plurality of pads arranged in layers, one above the other, each pad being formed from a honeycomb material having parallel facer sheets and honeycomb cells interposed between the facer sheets, with the axes of the cells being perpendicular to the facer sheets, each pad, having pockets that open toward the adjacent pad, each pocket receiving a portion of a rigid product so that the products are prevented from shifting laterally on the pad, the products being captured between adjacent pads; and a separator fitted between the mated components of each product and isolating the one component from the other component, but nevertheless, allowing the mated components to fit together.

12. The combination according to claim 11 wherein the two components of each product have scrolls formed by convolutions, and the components fit together at their scrolls; and wherein the separator for the product fits between the convolutions on the scrolls of two components.

13. The combination according to claim 11 wherein each separator is generally polygonal in shape; wherein the separators for the products on each pad lie in generally the same plane; and wherein the margins of the separators for adjacent products are close to each other, so the products do not rotate on the pad.

* * * * *